United States Patent [19]

Myhre

[11] Patent Number: 4,464,962

[45] Date of Patent: Aug. 14, 1984

[54] ADJUSTABLE MITER GUIDE DEVICE

[76] Inventor: Ragnvald Myhre, Box 148, R.D. #1, Greenville, N.Y. 12083

[21] Appl. No.: 418,806

[22] Filed: Sep. 16, 1982

[51] Int. Cl.[3] ..... B27B 25/08

[52] U.S. Cl. ..... 83/425; 83/437; 83/477.2

[58] Field of Search ..... 83/435, 435.1, 477, 83/477.2, 437, 421, 581, 474

[56] References Cited

U.S. PATENT DOCUMENTS 3,830,127 8/1974 James ..... 83/435.1

4,165,668 8/1979 McCord, Jr. ..... 83/435.1

*Primary Examiner*—James M. Meister

*Assistant Examiner*—J. L. Knoble

*Attorney, Agent, or Firm*—Charles J. Brown

[57] ABSTRACT

An adjustable miter guide device for a table saw having parallel tracks to each side of a saw blade wherein two guide assemblies are provided each with a rail which can be fixed in any one of an infinite number of positions relative to a runner slidable along one of the tracks. The guide assemblies are interconnected by an adjustable common link bridging the saw blade so that one workpiece can be disposed laterally against one guide rail and the other workpiece disposed laterally against the other guide rail with an end portion overlapping the firstmentioned workpiece and abutting the firstmentioned guide rail for movement together into cutting engagement with the saw blade.

8 Claims, 4 Drawing Figures

FIG. 2
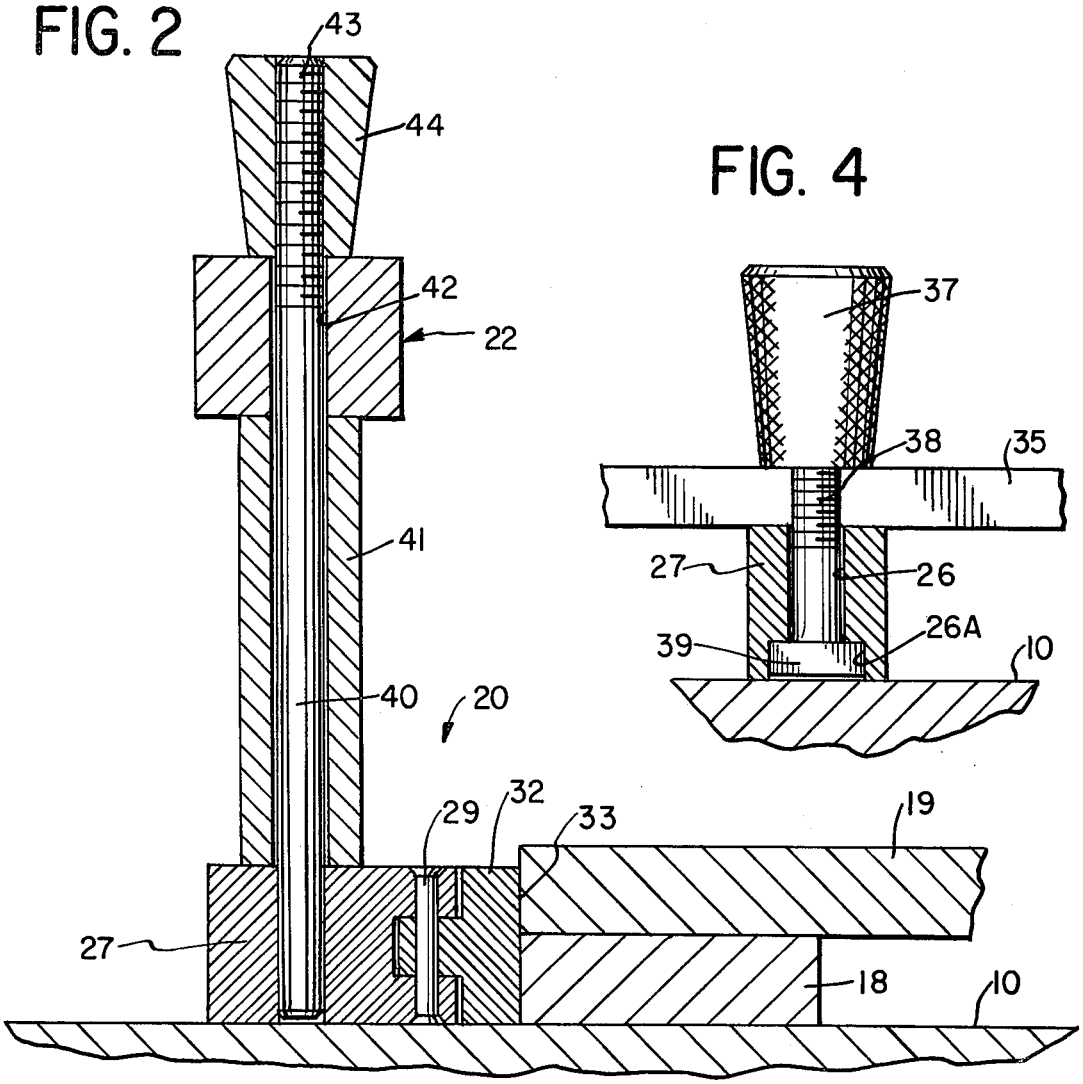
FIG. 4
FIG. 3
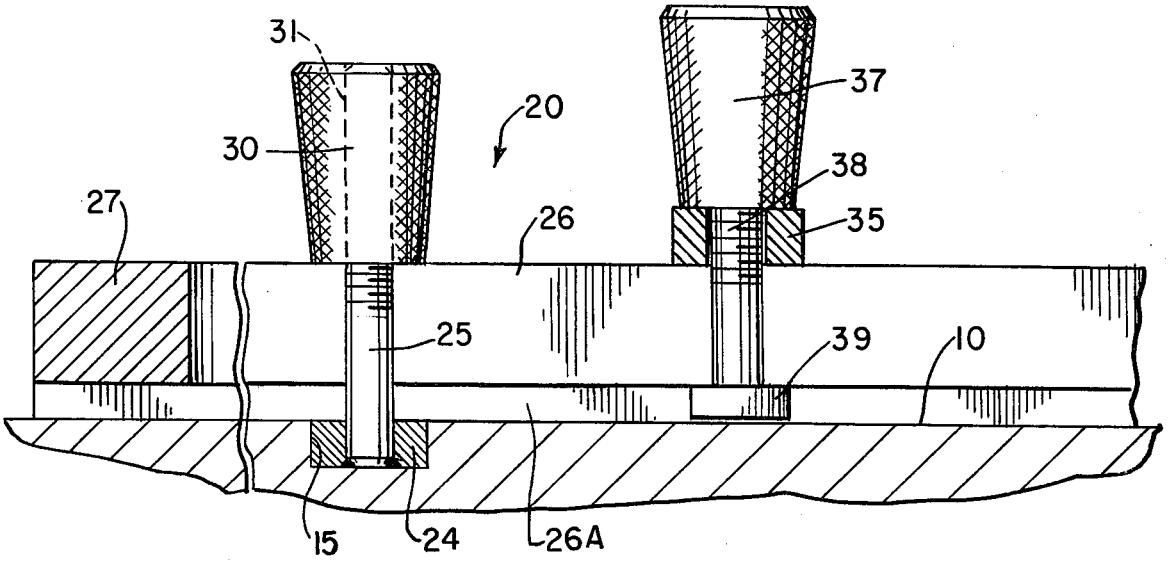

ADJUSTABLE MITER GUIDE DEVICE

BACKGROUND OF THE INVENTION

Miter guide devices, sometimes called fixtures or guages are well known for cutting complementary angled surfaces on workpieces. U.S. Pat. No. 4,165,668 describes a modern miter guage assembly for use with a table saw and it refers to a number of representative earlier patents on similar devices. In none of these prior art patents, however, is there a disclosure of right and lefthand guide assemblies which have every possible degree of freedom so that workpieces can be held in any one of an infinite number of overlapped positions on the saw table. See U.S. Pat. No. 3,344,819 for a disclosure of an illustrative miter guage having certain limited degrees of freedom.

It is the principal objection of the present invention to provide matched right and lefthand guide assemblies each having a number of articulated parts which can be locked together in an infinite variety of rigid positions. This permits the choice of one optimum miter position, depending upon the size and number of overlapped workpieces which are to be advanced together into the saw.

STATEMENT OF THE INVENTION

In accordance with the invention an adjustable miter guide device is provided for use with a saw table having parallel tracks on a worksurface with a saw blade extending upwardly therebetween. The guide device is slidable along the tracks and holds at least two workpieces in overlapped relation on the worksurface so that they can be moved together into cutting engagement with the blade. The guide device comprises first and second right and lefthand guide assemblies for association with the respective tracks. Each guide assembly comprises a runner slidable along the track, a cross arm attached to the runner and adapted to lie on the worksurface and pivot means at one end of the cross arm. Also included in each guide assembly are first adjustable connecting means remote from the pivot means for fixing the cross arm to the runner in a selected angular and linear position. A guide rail in each guide assembly is pivoted at one end to the cross arm by the pivot means and is adapted to lie on the worksurface. Each guide assembly also includes second adjustable connecting means remote from the pivot means for fixing the guide rail to the cross arm in a selected angular position. The guide device of the invention further includes a common link attached to the pivot means of the cross arm of the two guide assemblies and adapted to bridge over the saw blade. A third adjustable connecting means is provided for fixing the common link to the respective guide assembly cross arms in a selected angular and linear position relative thereto.

By this construction the two guide rails of the two guide assemblies can be fixed in one of an infinite variation of positions relative to the runners with one workpiece disposed laterally against one guide rail and the other workpiece disposed laterally against the other guide rail, with an end portion overlapping the first mentioned workpiece and abutting the first mentioned guide rail, for movement together into cutting engagement with the saw blade.

In a preferred form of the invention the first adjustable connecting means comprises a first lock nut and screw extending fixedly from the runner and slidably through a longitudinal slot in the cross arm. The second adjustable connecting means comprises an arcuate arm extending from the associated guide rail and a second lock nut and screw extending slidably through a longitudinal slot in the cross arm and slidably through an arcuate slot in the arcuate arm. The third adjustable connecting means comprises third lock nuts and screws extending fixedly from the respective ends of the respective cross arms adjacent the respective pivot pins and slidably through a longitudinal slot in the common link.

BRIEF DESCRIPTION OF THE DRAWINGS

FIG. 2 is an enlarged fragmentary section taken along the line 2—2 of FIG. 1;

FIG. 3 is an enlarged fragmentary section taken along the line 3—3 of FIG. 1; and FIG. 4 is an enlarged fragmentary section taken along the line 4—4 of FIG. 1.

DESCRIPTION OF PREFERRED EMBODIMENT

Figure 1:
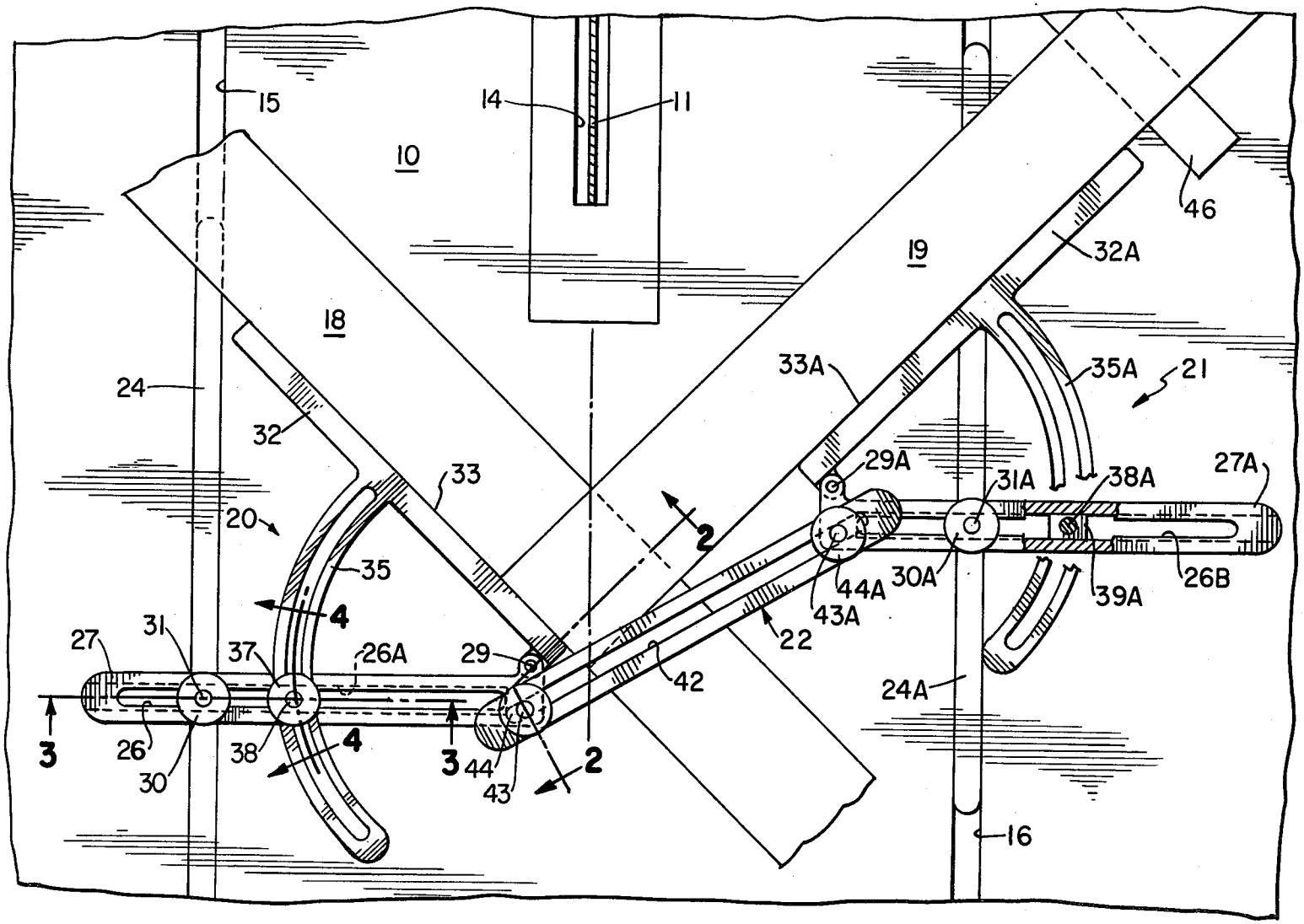
FIG. 1 is a fragmentary plan view partly in section showing the saw table surface with the miter guide device of the invention and associated workpieces thereon.

Referring first to FIG. 1 a conventional table saw is illustrated having a horizontal worksurface 10 with a circular saw blade 11 extending upwardly through an opening 14 in the worksurface. Track slots 15 and 16 are formed in the worksurface 10 of the table saw to each side of the saw blade 11 parallel to one another and to the blade 11.

The adjustable miter guide device of the invention is slidable along the track slots 15 and 16 and is designed to hold first and second workpieces 18 and 19 in overlapping relation on the worksurface 10 so that they can be moved together into cutting engagement with the blade 11. As shown in FIG. 1 the workpieces 18 and 19 are illustrated as wooden boards, perhaps one inch by four inches in cross section, and it is intended in this example that they be given a common miter cut of forty-five degrees off the centerline. It will be apparent from the following description that adjustment of the miter device of the invention permits this setting but can also permit an infinite variety of other angles of cut.

The device of the invention includes three basic components, a first or righthand guide assembly 20, a second or lefthand guide assembly 21 which is the mirror image (i.e. allochiral form of the first assembly 20) and finally a common link 22 interconnecting the assembly 20 and 21. The first guide assembly 20 is described below in detail, as is the common link 22 and it is to be understood that the second guide assembly 21 is of exactly the same construction as the assembly 20 except that certain of its parts are of a lefthand form rather than a righthand form. It will be noted that the first or righthand guide assembly 20 is associated with the track slot 15 whereas the second or lefthand assembly is associated with the track slot 16.

Referring now to FIGS. 1 and 3, an extended runner 24 is disposed slidably within the track slot 15 and has a matching rectangular cross section so that lateral movement in the slot is minimal. The runner 24 is flush with the worksurface 10 of the saw table as shown in FIG. 3. An upstanding shaft 25 is fixed to the runner 24 at its midpoint. The shaft 25 extends through a longitudinal slot 26 formed in an extended cross arm 27 through a longitudinal slot 26 formed in an extended cross arm 27 which lies on the worksurface 10 of the saw table. The slot 26 is closed at its opposite ends except that it includes a wider lower portion 26A which is open on the left end of the cross arm 27 as viewed in FIG. 1. By this construction the cross arm 26 can be moved back and forth across the runner 24 with the shaft 25 sliding free in the slot 26.

At the opposite right end of the cross arm 27 as shown particularly in FIGS. 1 and 2 is a pivot pin 29 which has a function described in detail hereinafter.

First adjustable connecting means are provided remote from the pivot pin 29 for fixing the cross arm 27 to the runner 24 in a selected angular and linear position. Such means comprise a first lock nut 30 and screw 31 which is simply a threaded upper extension of the shaft 25. Once the cross arm 27 is turned clockwise or counterclockwise about the shaft 25 to its desired position and is translated slidably across the runner 24 to its desired linear position the lock nut 30 is screwed tight and the cross arm is thereby fixed in the selected angular and linear position. In FIG. 1 this is shown as a position at right angles to the runner 24 with the greater part of the length of the cross arm extending to the left of the shaft 25, though it is evident that this is only one of an infinite number of such positions.

The first guide assembly 20 also includes a guide rail 32 pivoted at one end to the cross arm 27 by the pivot pin 29, previously referred to. The guide rail is adapted to lie on the worksurface 10 as shown for example in FIG. 3 with a workpiece guide surface 33 extending higher than the combined thicknesses of the first and second workpieces 18 and 19. Second adjustable connecting means remote from the pivot pin 29 are provided for fixing the guide rail 32 to the cross arm 27 in a selected angular position. Such means include an arcuate arm 35 extending rigidly from the associated guide rail and formed with an arcuate slot having a centerpoint at the axis of the pivot pin 29. As shown in FIGS. 1, 3 and 4 the second adjustable connecting means comprises a second lock nut 37 and screw 38 which extends slidably through the longitudinal slot 26 into the wider portion 26A thereof where a circular head 39 on the screw 38 is affixed. By this construction the guide rail 32 can be turned to the desired angle with relation to the cross arm 27 and fixed in that position.

It will be understood that the second guide assembly 21 shown in FIG. 1 comprises a runner 24A in the slot 16, a cross arm 27A having a longitudinal slot 26B, and a pivot pin 29A. A lock nut 30A on a screw 31A secures the cross arm 27A to the runner 24A and the cross arm 27A is connected by a pin 29A to a guide rail 32A from which extends a slotted arcuate arm 35A. A lock nut 37A on a lock screw 38A secures the arcuate arm 35A in the desired angular position in relation to the cross arm 27A. This structure of the second guide assembly 21 is the mirror image of the structure of the first guide assembly 20 and the function is the same.

The common link 22 previously referred to is attached to the ends of the cross arms 27 and 27A adjacent their respective pivot pins 29 and 29A. As shown in FIG. 2 a shaft 40 is fixed to the cross arm 27 at its lower end and extends upwardly through a spacer sleeve 41 and through a slot 42 in the link 22. The upper end of the shaft 40 is threaded to a lock screw 43 and about which is threaded a lock nut 44. A lock screw 42A and lock nut 44A are similarly located at the other end of the link 22 and the cross arm 27A as shown in FIG. 1.

In the operation of the guide device of the invention the various lock nuts 30 and 30A, 37 and 37A and 44 and 44A are all loosened and the runners 24 and 24A are located in the track slots 15 and 16 of the saw table. The workpiece 18 is laid on the table laterally against the worksface 33 of the guide rail 32 and it may extend in indefinite length under the common link 22. The end portion of the other workpiece 19 is laid over the workpiece 18 and a spacer block 46 of the same thickness as the workpiece 18 holds the workpiece 19 parallel to the worksurface 10 of the saw table. The two workpieces 18 and 19 are then moved together to the desired common angle and to the desired position in relation to the saw blade 11. Because of the unlimited degrees of freedom of the guide rails 32 and 32A it is possible to fix the relative positions of the workpieces exactly where the operator desires. In so moving the workpieces to the desired position the cross arms 27 and 27A may slide in relation to the lock screws 31 and 31A and also turn angularly in relation thereto. The guide rails 32 and 32A may be turned angularly in relation to the cross arms 27 and 27A about the pivot pins 29 and 29A. Also the ends of the cross arms 27 and 27A near those pivot pins may be moved longitudinally with respect to the runners 24 and 24A by movement of the lock screws 43 and 43A in the slot 42. When all of these adjustments are complete the lock nuts 30 and 30A, 37 and 37A and 44 and 44A are turned tight and the guide device becomes a rigid fixture slidable in the track slots 15 and 16. The common cut made through both workpieces by the saw blade 11 can be repeated with other workpieces and no variation in dimension or position of the cut will take place.

Various modifications can be made in the foregoing preferred embodiment of the miter guide device of the invention without departing from the scope of the invention, which is set forth in the following claims.

I claim:

1. For use with a saw table having parallel tracks on a worksurface with a saw blade extending upwardly therebetween, an adjustable miter guide device slidable along said tracks for holding at least two workpieces in overlapped relation on the worksurface and moving them into cutting engagement with the blade, said device comprising:

(a) first and second right and left hand assemblies for association with the respective tracks each comprising
  i. a runner slidable along the track,
  ii. a cross arm attached to the runner and adapted to lie on the worksurface,
  iii. pivot means at one end of the cross arm,
  iv. first adjustable connecting means remote from the pivot means for fixing the cross arm to the runner in a selected angular and linear position,
  v. a guide rail pivoted at one end to the cross arm by the pivot means and adapted to lie on the worksurface; and
  vi. second adjustable connecting means remote from the pivot means for fixing the guide rail to the cross arm in a selected angular position;

(b) a common link attached to the cross arms of the two guide assemblies and adapted to bridge over the saw blade; and (c) third adjustable connecting means for fixing the common link to the respective guide assembly cross arms in a selected angular and linear position relative thereto;

(d) whereby the two guide rails of the two guide assemblies can be fixed in one of an infinite variation of positions relative to the runners with one workpiece disposed laterally against one guide rail and the other workpiece disposed laterally against the other guide rail with an end portion overlapping the firstmentioned workpiece and abutting the firstmentioned guide rail for movement together into cutting engagement with the saw blade.

2. An adjustable miter guide device according to claim 1 wherein the parallel tracks on the saw table are respective slots in the worksurface and the slidable runners are extended elements disposable within the respective slots.

3. An adjustable miter guide device according to claim 1 wherein the pivot means at one end of each cross arm is a pivot pin.

4. An adjustable miter guide device according to claim 1 wherein the first adjustable connecting means on each cross arm comprises a first lock nut and screw extending fixedly from the runner and slidably through a longitudinal slot in the cross arm.

5. An adjustable miter guide device according to claim 1 wherein the guide rail has a workpiece guide surface extending higher than the combined thicknesses of the workpieces.

6. An adjustable miter guide device according to claim 1 wherein the second adjustable connecting means comprises an arcuate arm extending from the associated guide rail and a second lock nut and screw extending slidably through a longitudinal slot in the cross arm and slidably through an arcuate slot in the arcuate arm.

7. An adjustable miter guide device according to claim 1 wherein the third adjustable connecting means comprises third lock nuts and screws extending fixedly from the respective ends of the respective cross arms adjacent the respective pivot pins and slidably through a longitudinal slot in the common link.

8. For use with a worktable having parallel track slots on a worksurface with a circular saw blade extending upwardly therebetween, and adjustable miter guide device slidable along said track slots for holding at least two workpieces in overlapped relation on the worksurface and moving them together into cutting engagement with the blade, said device comprising (a) first and second right and lefthand guide assemblies for association with the respective track slots each comprising i. an extended runner disposable within and slidable along the track slot, ii. a cross arm attached to the runner and adapted to lie on the worksurface, iii. a pivot pin at one end of the cross arm, iv. first adjustable connecting means remote from the pivot pin for fixing the cross arm to the runner in a selected angular and linear position comprising a first lock nut and screw extending fixedly from the runner and slidably through a longitudinal slot in the cross arm, v. a guide rail pivoted at one end to the cross arm by the pivot pin and adapted to lie on the worksurface with a workpiece guide surface extending higher than the combined thicknesses of the workpieces, and vi. second adjustable connecting means remote from the pivot pin for fixing the guide rail to the cross arm in a selected angular position comprising an acruate arm extending from the associated guide rail and a second lock nut and screw extending slidably through a longitudinal slot in the cross arm and slidably through an arcuate slot in the arcuate arm;

(b) a common link attached to the cross arms of the two guide assemblies and adapted to bridge over the saw blade; and (c) third adjustable connecting means for fixing the common link to the respective guide assembly cross arms in a selected angular and linear position relative thereto comprising third lock nut and screws extending fixedly from the respective ends of the respective cross arms adjacent the respective pivot pins and slidably through a longitudinal slot in the common link; and (d) whereby the two guide rails of the two guide assemblies can be fixed in one of an infinite variation of positions relative to the runners with one workpiece disposed laterally against one guide rail and the other workpiece disposed laterally against the other guide rail with an end portion overlapping the firstmentioned workpiece and abuttng the firstmentioned guide rail for movement together into cutting engagement with the saw blade.

* * * * *